US006660102B2

(12) United States Patent
Jeutter et al.

(10) Patent No.: US 6,660,102 B2
(45) Date of Patent: Dec. 9, 2003

(54) METHOD OF DECOATING A TURBINE BLADE

(75) Inventors: Andre Jeutter, Grafenau (DE); Helge Reymann, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/033,036

(22) Filed: Dec. 27, 2001

(65) Prior Publication Data

US 2002/0148488 A1 Oct. 17, 2002

(51) Int. Cl.[7] ..... B08B 3/02; B08B 3/08; C23G 1/02

(52) U.S. Cl. ..... 134/28; 134/3; 134/26; 134/41

(58) Field of Search ..... 134/3, 26, 28, 134/41

(56) References Cited

U.S. PATENT DOCUMENTS 4,339,282 A * 7/1982 Lada et al. ..... 134/3
5,167,721 A 12/1992 McComas

FOREIGN PATENT DOCUMENTS

EP 1013797 12/1998

* cited by examiner

*Primary Examiner*—Zeinab El-Arini
(74) *Attorney, Agent, or Firm*—Harness, Dickey & Pierce, P.L.C.

(57) ABSTRACT

A method is directed toward decoating a parent body, provided with an anti-corrosion coating, of a turbine blade. An outer part of the anti-corrosion coating is removed abrasively by a water jet. An inner part of the anti-corrosion coating is then removed chemically. This combination permits efficient and cost-effective decoating of the turbine blade.

15 Claims, 1 Drawing Sheet

METHOD OF DECOATING A TURBINE BLADE

The present application hereby claims priority under 35 U.S.C. Section 119 on European application number EP 00128573.3, the entire contents of which are hereby incorporated herein by reference.

FIELD OF THE INVENTION

The invention generally relates to a method of decoating a parent body, preferably provided with an anti-corrosion coating, of a turbine blade.

BACKGROUND OF THE INVENTION

Turbine blades, in particular gas turbine blades, are often provided with an anticorrosion coating for protection against corrosion and oxidation. Especially in the case of gas turbine blades which are used in a gas turbine at temperatures above 600° C. or even above 1000° C., such a protective coating is important for achieving a sufficiently long life.

Such a protective coating is usually made of a material of the group MCrAlX, where M stands for iron, cobalt or nickel, Cr stands for chromium, Al stands for aluminum, and X is selected from the group of yttrium, scandium, lanthanum and rare earths. For use at especially high temperatures, such a protective coating is often applied to a parent body of the turbine blade, the parent body including a nickel- or cobalt-base superalloy. In addition, a ceramic thermal-insulation layer may be applied to the anti-corrosion coating.

The coating wears out with time due to oxidation and corrosion; erosion and mechanical damage may also occur. In order not to have to exchange the turbine blades completely after a certain operating period, it is generally worthwhile restoring the protective coating. This "refurbishment" first of all requires the careful removal of the old anti-corrosion coating from the turbine blade.

WO 93/03201 shows such a decoating process. Here, an old anti-corrosion coating in which, in particular, corrosion products are embedded is treated by cleaning and by subsequent application of an aluminide coating. With the subsequent removal of this aluminide coating, the anti-corrosion coating together with the corrosion products is also removed. This process is very effective, but comparatively complicated and expensive.

SUMMARY OF THE INVENTION

An object of the invention is to specify an effective and cost-effective method of removing an anti-corrosion coating from a turbine blade.

According to the invention, this object is achieved by, for example, a method of decoating a parent body, provided with an anti-corrosion coating, of a turbine blade. Preferably, a first, outer part, lying on the outside relative to the parent body, of the anticorrosion coating is removed abrasively by a water jet. Thereafter, a second, inner part, lying between the outer part and the parent body before the removal of the outer part, of the anticorrosion coating is removed chemically.

Such a method, for the first time, combines mechanical removal of an anti-corrosion coating by use of a water jet, with chemical removal. The mechanical removal is especially quick and thus cost-effective. However, removal of the anti-corrosion coating solely by use of the water jet could lead to damage to the parent body, which must as far as possible remain unaltered in its surface form, especially on account of aerodynamic requirements. Therefore only an outer part of the anti-corrosion coating is removed by the water jet. Further removal is subsequently effected via chemical attack.

A) The anti-corrosion coating has an average total coating thickness, the outer part preferably having an outer-part coating thickness which is at least 70% of the total coating thickness. The largest proportion of the anti-corrosion coating is therefore preferably removed abrasively via the water jet. It is also preferred that the outer-part coating thickness is at most 95% of the total coating thickness. This ensures that the water jet does not strike the parent body and cannot damage the latter as a result.

B) The inner part is preferably removed by using hydrochloric acid.

C) The water jet preferably strikes the anti-corrosion coating under a pressure level between 10–100 bar.

D) The anti-corrosion coating preferably includes MCrAlX, where M is selected from the group (iron, cobalt, nickel), Cr is chromium, Al is aluminum, and X is selected from the group (yttrium, scandium, lanthanum, rare earths). Such an anti-corrosion coating is especially effective at very high temperatures. During long-term stress, such an MCrAlX coating is subjected to a depletion of the beta phase. This depletion of the beta phase in the outer region of the anti-corrosion coating leads to a situation in which chemical attack alone, for removing the anti-corrosion coating, is only possible with difficulty and in a complicated manner. Especially in the case of such a beta-depleted anti-corrosion coating, the combination of the chemical decoating with previous abrasive, mechanical decoating is therefore especially advantageous.

E) The parent body preferably includes a nickel- or cobalt-base superalloy. Such an alloy is especially resistant to high temperatures, but is also more expensive than, for instance, high-temperature-resistant steels. Accordingly, the "refurbishment", that is the decoating and subsequent re-application of a new coating, is worthwhile, especially in the case of such a parent body.

F) After the chemical removal, the residual coating thickness of the anticorrosion coating is preferably determined. This may be done, for example, thermographically. In this way, the points on the parent body where there are still residues of the anti-corrosion coating are determined and the thickness of the residual coating regions is determined. Such remaining coating regions of the anti-corrosion coating which have a residual coating thickness greater than 5% of the original total coating thickness are then preferably also removed abrasively with the water jet down to a minimum thickness. In sections, therefore, comparatively thick coating regions are removed again by a water-jet treatment, although here the coating regions are not removed right down to the parent body but preferably only down to a minimum thickness in order to protect the parent body. Further chemical removal of remaining residual coating regions is then also preferably carried out.

G) The parent body is preferably single-crystalline or directionally solidified. Such a parent body has an especially high loading capacity under centrifugal forces and is produced in a comparatively complicated and expensive manner. Here, reprocessing of the anti-corrosion coating is especially appropriate economically.

H) The parent body preferably has a longitudinal extent greater than 20 cm. Especially in the case of such large turbine blades, conventional refurbishment is very time-consuming and thus expensive. Here, the combined treatment with a water jet and chemical removal leads to especially high cost advantages.

The embodiments according to paragraphs A) to H) may also be combined with one another in any desired manner.

BRIEF DESCRIPTION OF THE DRAWINGS

The invention is explained in more detail by way of example and with reference to the drawings, in which, partly schematically and not to scale.

The same reference numerals have the same meaning in the various figures.

DETAILED DESCRIPTION OF THE PREFERRED EMBODIMENTS

Figure 1:
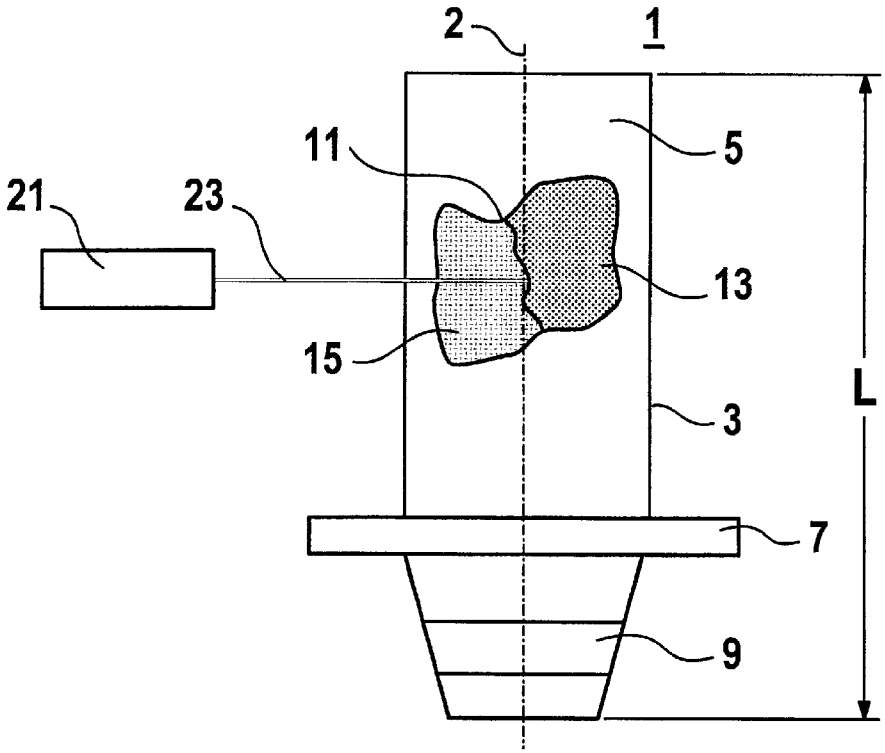
FIG. 1 shows the removal of an anti-corrosion coating on a turbine blade by use of a water jet.

FIG. 1 shows a gas turbine blade 1. The gas turbine blade 1 has a parent body 3 including a nickel- or cobalt-base superalloy. The gas turbine blade 1 is directed along a blade axis 2. Following a blade body 5 along the blade axis 2 is a platform region 7 and a fastening region 9. An anti-corrosion coating 11 is applied to the surface of the blade-body region 5 and also to that surface of the platform region 7 which faces the blade-body region 5. This anticorrosion coating 11 consists of an MCrAlY alloy. The anti-corrosion coating 11 has an outer part 13 lying on the outside relative to the parent body 3. An inner part 15 of the anticorrosion coating 11 is arranged between the outer part 13 and the parent body 3. The distinction between outer part 13 and inner part 15 does not necessarily mean a chemical or crystallographic difference between these regions. On the contrary, in the decoating method, the outer part 13 is defined by virtue of the fact that it is removed by a water jet 23 from a water-jet device 21.

Decoating by use of a water jet considerably accelerates the entire operation of removing the anti-corrosion coating 11 from the gas turbine blade 1. Especially for large gas turbine blades 1 having a longitudinal extent L (measured along the blade axis 2) of greater than 20 cm, this time advantage leads to considerable cost reductions. However, the anticorrosion coating 11 is not removed right down to the parent body 3 by the water jet 23. On the contrary, the inner part 15 is retained on the parent body 3. This ensures that the water jet 23 does not strike the parent body 3, for instance in a damaging manner, or alters the latter in an aerodynamic manner at its surface.

After the decoating by use of the water jet 23, the inner part 15 is chemically removed. This is preferably done by use of hydrochloric acid. The removal by use of the water jet 23 does not necessarily lead to a residual coating with the inner part 15 having a homogeneous coating thickness. The coating thickness may vary locally.

Figure 2:
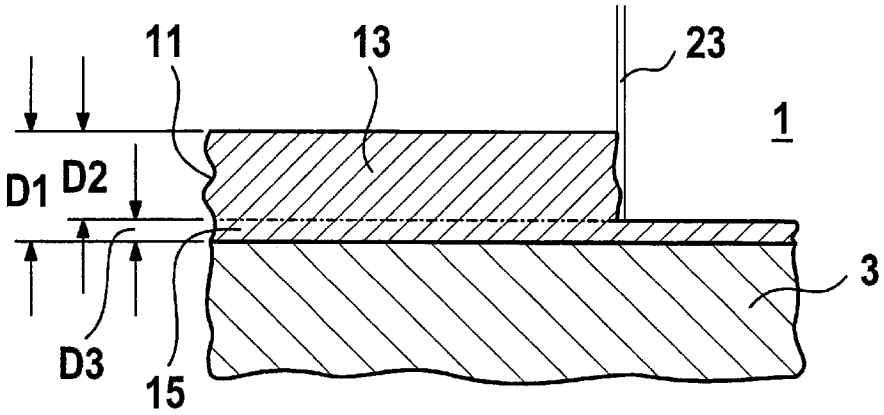
FIG. 2 shows a detail of a cross section through a turbine blade with an anti-corrosion coating.

A longitudinal section through a detail of the gas turbine blade 1 is shown in FIG. 2. An anti-corrosion coating 11 is arranged on the parent body 3. The outer part 13 of the anticorrosion coating 11 has already been partly removed by the water jet 23. The anti-corrosion coating 11 has a total coating thickness D1. The outer part 13 of the anti-corrosion coating 11 has an outer-part coating thickness D2. The inner part 15 of the anti-corrosion coating 11 has an inner-part coating thickness D3. The outer-part coating thickness D2 is preferably greater than 70% of the total coating thickness D1, but preferably less than 95% of the total coating thickness D1. In this way, on the one hand, the removal of a large part of the anti-corrosion coating 11 is achieved by use of the water jet 23 and thus in a cost-effective manner. On the other hand, the water jet 23 is prevented from striking the parent body 3.

Figure 3:
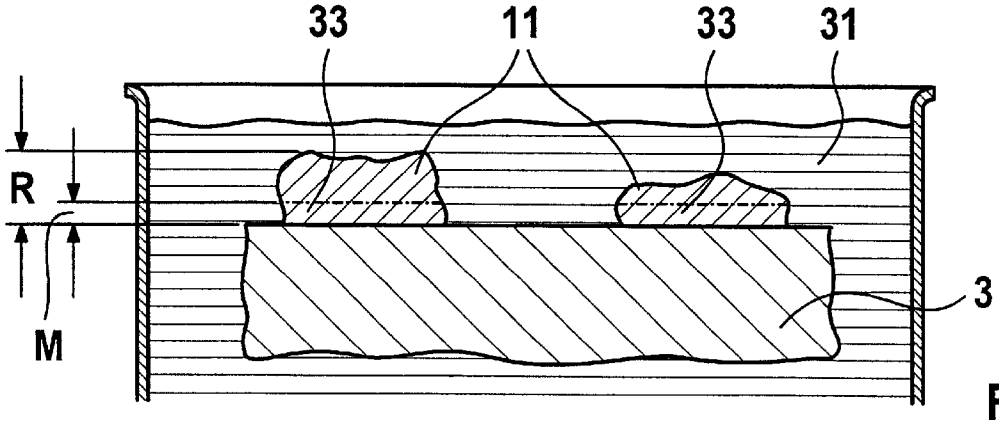
FIG. 3 shows chemical removal of an anti-corrosion coating on a turbine blade.

FIG. 3 schematically shows the chemical removal in a hydrochloric-acid bath 31. The inner part 15 of the anti-corrosion coating 11 is substantially removed by the hydrochloric-acid bath 31. After such a treatment, however, local coating regions 33 of the anti-corrosion coating 11 may remain. Such coating regions 33 are determined by a suitable method, e.g. thermographically. If such coating regions 33 still have a residual coating thickness R which is still comparatively large, abrasive removal may be effected again by use of the water jet 23 down to a minimum coating thickness M. The coating regions 33 are then subjected to an acid treatment again. If need be, this method is repeated several times. Ultimately, the turbine blade 1 is decoated virtually completely in an efficient manner. A new anti-corrosion coating 11 may now be applied to a turbine blade 1 thus decoated.

The invention being thus described with regard to preferred embodiments thereof, it will be apparent that the same may be varied in many ways. Such variations are not to be regarded as a departure from the spirit and scope of the invention, and all such modifications as would be apparent to one of ordinary skill in the art are intended to be included within the scope of the following claims.

What is claimed is:

1. A method of decoating a parent body, provided with an anti-corrosion coating, of a turbine blade, comprising:

abrasively removing an outer part, relative to the parent body, of the anti-corrosion coating using a water jet, wherein a coating thickness of the outer part is at least 70% of a total thickness of the anti-corrosion coating; and chemically removing an inner part of the anti-corrosion coating, between the outer part and the parent body, wherein the anti-corrosion coating is a metallic coating.

2. The method as claimed in claim 1, wherein the outer-part coating thickness is at most 95% of the total coating thickness.

3. The method as claimed in claim 1, wherein the chemically removing includes removing the inner part using hydrochloric acid.

4. The method as claimed in claim 3, further comprising:

determining, after the chemically removing, a residual coating thickness of the anti-corrosion coating.

5. The method as claimed in claim 4, further comprising:

abrasively removing coating regions of the anti-corrosion coating which remain after the residual coating thickness has been determined, and which have a residual coating thickness which is greater than 5% of an original total coating thickness, with the water jet, down to a minimum thickness.

6. The method as claimed in claim 5, further comprising chemically removing the remaining coating regions.

7. The method as claimed in claim 1, wherein the abrasively removing includes using the water jet to strike the anti-corrosion coating at a pressure between 10 bar and 100 bar.

8. The method as claimed in claim 1, wherein the anti-corrosion coating includes MCrAlX, where M is selected from the group consisting of iron, cobalt, and nickel; Cr is chromium; Al is aluminum; and X is selected from the group consisting of yttrium, scandium, lanthanum, rare earths.

9. The method as claimed in claim 1, wherein the parent body includes at least one of a nickel-base and a cobalt-base superalloy.

10. The method as claimed in claim 1, further comprising:

determining, after the chemically removing, a residual coating thickness of the anti-corrosion coating.

11. The method as claimed in claim 10, further comprising:

abrasively removing coating regions of the anti-corrosion coating which remain after the residual coating thickness has been determined, and which have a residual coating thickness which is greater than 5% of an original total coating thickness, with the water jet, down to a minimum thickness.

12. The method as claimed in claim 11, further comprising chemically removing the remaining coating regions.

13. The method as claimed in claim 1, wherein the parent body is at least one of a single-crystalline and directionally solidified.

14. The method as claimed in claim 13, wherein the parent body includes a longitudinal extent greater than 20 cm.

15. The method as claimed in claim 1, wherein the chemically removing includes removing the inner part using hydrochloric acid.

* * * * *